United States Patent [19]

Ryan

[11] 4,344,210

[45] Aug. 17, 1982

[54] ADJUSTABLE DRAPERY SUPPORT ASSEMBLY

[76] Inventor: Richard B. Ryan, 1205 Deertrail La., Libertyville, Ill. 60048

[21] Appl. No.: 172,835

[22] Filed: Jul. 28, 1980

Related U.S. Application Data

[63] Continuation-in-part of Ser. No. 73,668, Sep. 10, 1979, Pat. No. 4,261,080.

[30] Foreign Application Priority Data

[DE] Fed. Rep. of Germany .....

[51] Int. Cl.[3] ..... A44B 13/00

[52] U.S. Cl. ..... 24/369; 24/345; 24/375; 160/348

[58] Field of Search ..... 24/345, 347, 160, 369; 160/248

[56] References Cited

U.S. PATENT DOCUMENTS 1,056,384 3/1913 Umstatter ..... 24/347

1,219,902 3/1917 Anderson ..... 24/347

4,166,308 9/1979 Schmitz et al. ..... 24/345

*Primary Examiner*—Kenneth Downey

*Attorney, Agent, or Firm*—Merriam, Marshall & Bicknell

[57] ABSTRACT

An adjustable drapery support assembly comprises a first elongated plate member adapted to be inserted into the top of a pleat or fold in a drapery, and a second plate member hinged at its top to the top of the first member, with the edges of the members in substantial alignment. At a point spaced from the hinge, the plates are provided with interlocking means to secure the assembly to the drapery. The aligned edges of the plates are provided with suitable gripping means which supports the top of the drapery and prevents downward sagging. Along a side edge of the second plate opposite that aligned with the first plate, there is provided an adjustable attaching means including a hook assembly which can be attached at any desired point along the length of the plate.

6 Claims, 8 Drawing Figures

ADJUSTABLE DRAPERY SUPPORT ASSEMBLY

This application is a continuation-in-part of my copending application Ser. No. 73,668, filed Sept. 10, 1979, now U.S. Pat. No. 4,261,080.

This invention relates to a novel adjustable drapery support assembly which is economical to manufacture, which can be readily and inexpensively installed in a drapery, and which permits adjustment of the hanging length of the drapery over a sizable range while minimizing unsightly outward sagging of the top of the drapery.

INTRODUCTION

One of the problems involved in the manufacture and installation of a drapery is making adequate provision for adjusting the free length thereof at various points along its width so that the bottom edge of the drapery is uniformly spaced above the floor or other surface in proximity thereto. This problem arises not only at the initial installation of the drapery, but also at later times, e.g., after a cleaning procedure which may affect the length of the drapery, or after an extended period of use, during which the drapery material may have stretched or shrunk. Although the initial installation of custom-made draperies is usually made by experienced professional personnel who are competent to insure that the drapery is hung in a uniform manner, this is not true with respect to mass-produced draperies which must be hung by the purchaser. Further, in both instances, the draperies may be rehung, typically after cleaning, by the owner thereof, who is not normally adept in adjusting the free length of the drapery to insure that it hangs evenly.

A number of adjustable support assemblies for draperies have been suggested in the past, typically incorporating hooks or similar means at the top of the drapery, the position of which can be adjusted vertically over a sufficient distance to provide the necessary adjustment in length. In some of these assemblies, e.g., that shown in U.S. Pat. No. 2,931,612, there is employed a base plate member of a size and configuration which requires that it be sewn by hand into the drapery after pleats are formed therein. Such installation represents an additional operation which increase the cost of the drapery. Other forms of adjusable drapery hooks, e.g., those shown in U.S. Pat. Nos. 3,321,814, 2,448,637, and 2,901,759, are typically made of metal and are relatively complicated in form, both of which factors tend to increase the cost thereof.

Another form of adjustable support assembly is shown in German Patent Application (Offenlegungsschrift) No. 2,526,820, published Mar. 4, 1976, wherein the support assembly is provided with a thin vane of a flexible material, typically a synthetic resin, which is adapted to be sewn into the rear fold of a pleat of the drapery, the vane being provided with means for attaching a hook at any desired point along the length thereof, thereby affording a means for effectively adjusting the length of the drapery. Because this assembly must be inserted during the sewing of the drapery of skilled and therefore expensive labor, the cost of installation may be unacceptably high for use of the assembly in inexpensive mass-produced draperies.

SUMMARY OF THE INVENTION

In accordance with the invention, there is provided an adjustable drapery support assembly which can be easily and inexpensively installed in a drapery after the pleats have been formed. In a preferred embodiment, the assembly includes a provision for counteracting the tendency of the top of the drapery to sag outwardly when the point of support is lowered, a problem usually encountered with adjustable drapery supports. Briefly described, the support assembly of the invention comprises a first elongated plate member adapted to be inserted into the top of a pleat or fold in a drapery, and a second plate member hinged at its top to the top of the first member, with the edges of the members in substantial alignment. At a point spaced from the hinge, the plates are provided with interlocking means, including a prong affixed to one of the plates which penetrates a fold of the drapery and coacts with latch means on the other plate to secure the assembly to the drapery. The aligned edges of the plates are provided with suitable gripping means which supports the top of the drapery and prevents downward sagging. Along a side edge of the second plate opposite that aligned with the first plate, there is provided an adjustable attaching means including a hook assembly which can be attached at any desired point along the length of the plate. In a preferred embodiment, the side edges of the second plate are not parallel, but rather taper towards each other in an upward direction. Accordingly, as the position of the hook relative to the top of the assembly is lowered, outwardly tilting or sagging of the unsupported upper edge of the drapery is limited or reduced.

DESCRIPTION OF THE DRAWINGS

The invention will be better understood from the following detailed description thereof, taken in conjunction with the accompanying drawings in which.

DETAILED DESCRIPTION OF A PREFERRED EMBODIMENT

Figure 1:
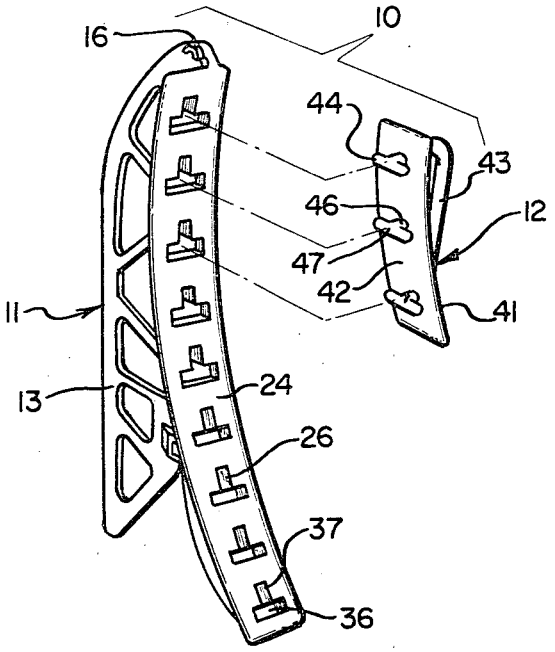
FIG. 1 is an isometric view of the two sub-assemblies which form the drapery support assembly of the invention.
Figure 2:
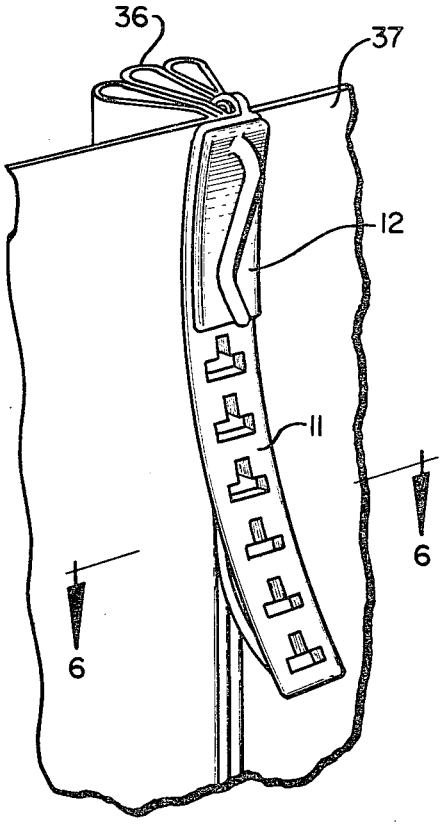
FIG. 2 is an isometric view of the assembly of the invention as it would appear installed in a pleat of a drapery.

As shown in the drawings, a drapery support assembly 10 in accordance with the invention comprises two sub-assemblies, a locking base assembly 11 and a hook assembly 12 which are provided with interlocking elements which permit the attachment of hook assembly 12 at a desired point along the length of base assembly 11.

Locking base assembly 11 comprises a first elongated plate member 13 and a second elongated plate member 14 which are attached at their upper ends by hinge means 16. First plate member 13, which can be solid or apertured as shown to reduce its weight, is generally rectangular in outline and has a width appropriate for insertion into a pleat of a drapery, the width of the plate serving as positioning means to maintain the pleat in a position generally perpendicular to the face of the drapery. The inner edges 17 and 18 of plates 13 and 14 respectively are generally aligned and are provided with gripping means, e.g., barbs 19, which grip the fabric of the drapery when the assembly is locked and prevent any tendency of the material to sag. At a location spaced from hinge means 16 and located near the bottom ends of each plate, are interlocking means consisting of prong 21 attached to second plate 14 and latch 22 attached to first plate 17.

Figure 7:
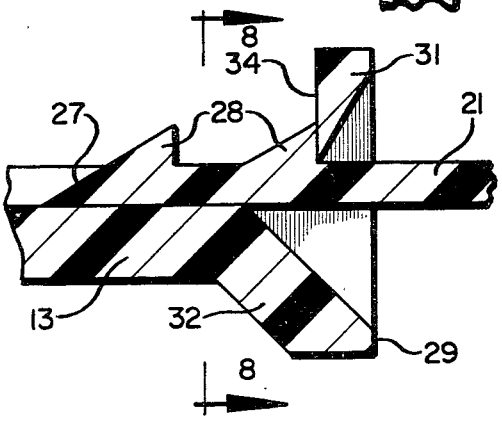
FIG. 7 is a sectional view along the line 7—7 of FIG. 3, showing a prong which interlocks with the latch means of FIG. 5.
Figure 8:
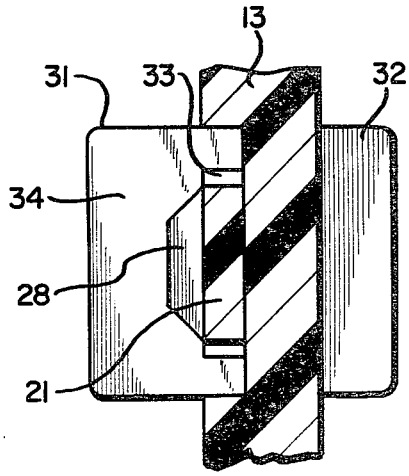
FIG. 8 is a sectional view of the interlock means, along the line 8—8 of FIG. 7.

Prong 21, which extends from edge 18 of second plate 14 toward edge 19 of first plate 13 has a sharpened tip 27 and one or more barbs 28 (FIG. 7). Latch 22 comprises a frame 29 having two opposite inwardly sloping walls 31 and 32 partially defining an aperture 33 which is sufficiently offset with respect to first plate 13 to permit prong 21 to pass therethrough. The entire locking base assembly 11, including prong 21, latch 22, and hinge 16, is suitably integrally formed of a semi-rigid plastic material. Accordingly, walls 31, 32 and barbs 28, being inherently resilient, will deform sufficiently to permit barbs 28 to pass beyond the inner face 34 of wall 31 into the locked position shown in FIG. 7. When this condition is achieved, however, the blunt rear edge of barb 28 abuts against the inner face 34 of wall 31, thus preventing removal of prong 21 and achieving a permanent connection.

Attached to and extending along the outer edge 23 of plate 14, is a transverse locking rib 24 which has a length sufficient to provide the desired range of height adjustment in the drapery. Extending along the length of locking rib 24 are a plurality of equally spaced apertures 26 in the form of inverted T's, including a horizontal base portion 36 and a vertical stem portion 37. In order to prevent any interference with apertures 26, rib 24 is laterally offset, being joined along one of its edges to plate 14.

Hook assembly 12 comprises a base plate 41 having an outer face 42 which is flat or curved as necessary to match the contour of locking rib 24. On the opposite (inner) face of plate 41 is attached a hook 43 adapted to be suspended from a traverse rod or the like (not shown). Protruding from the outer face 42 of plate 41 is at least one, and preferably two or more barbs 44, each of which comprises a shaft 46 to the end of which is fixed a transverse cross-piece 47. Barbs 44 are uniformly spaced along the length of plate 41 at an interval equal to the spacing of T-shaped apertures 26 in locking rib 24 of base assembly 11. Similarly, the dimensions of cross-pieces 47 and shafts 46 are such as to permit the cross-pieces to enter base portions 36 of apertures 26 and to permit shafts 46 to enter stem portions 37 thereof.

Figure 3:
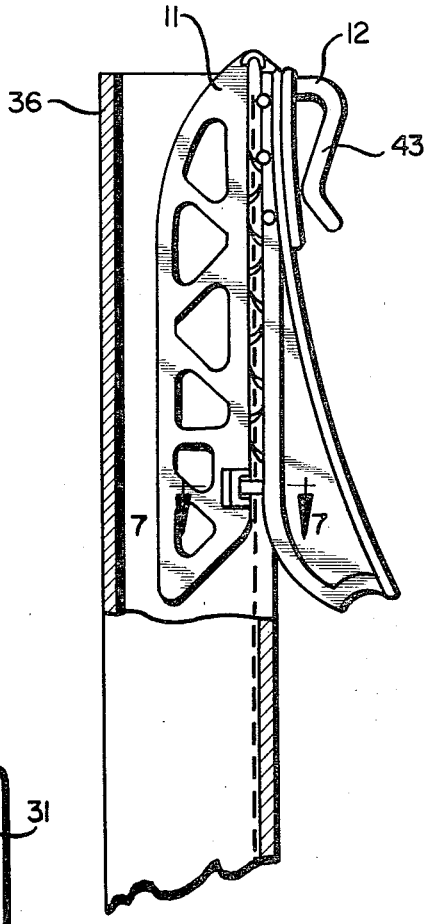
FIG. 3 is a side view of the assembly shown in FIG. 2 with a portion of the drapery material cut away.
Figure 5:
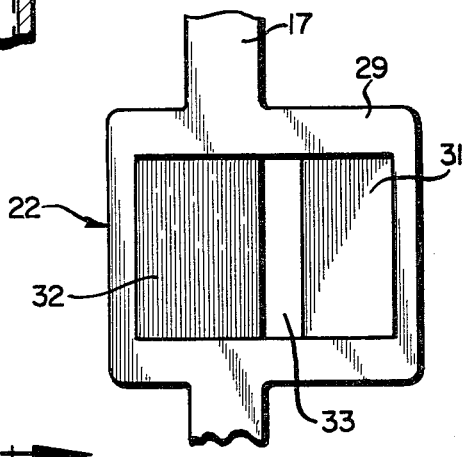
FIG. 5 is a cross-section along the line 5—5 of FIG. 4, showing the latching means used to interlock the plates.

Although second plate 14 may have any appropriate shape, e.g., rectangular, it is preferred that it have an outline which tapers inwardly toward hinge 16. Accordingly, when the support assembly of the invention is installed in a drapery, as shown in FIG. 3, locking rib 24 assumes an inclined, rather than a vertical position, whereby the assembly tends to prevent or minimize outward sagging or tilting of the top section of the drapery, as explained in said application Ser. No. 73,668, now U.S. Pat. No. 4,261,080. Although rib 24 can be straight or convex, it is preferred that it be outwardly concave and that its upper end terminate as close to hinge 16 as possible.

Figure 6:
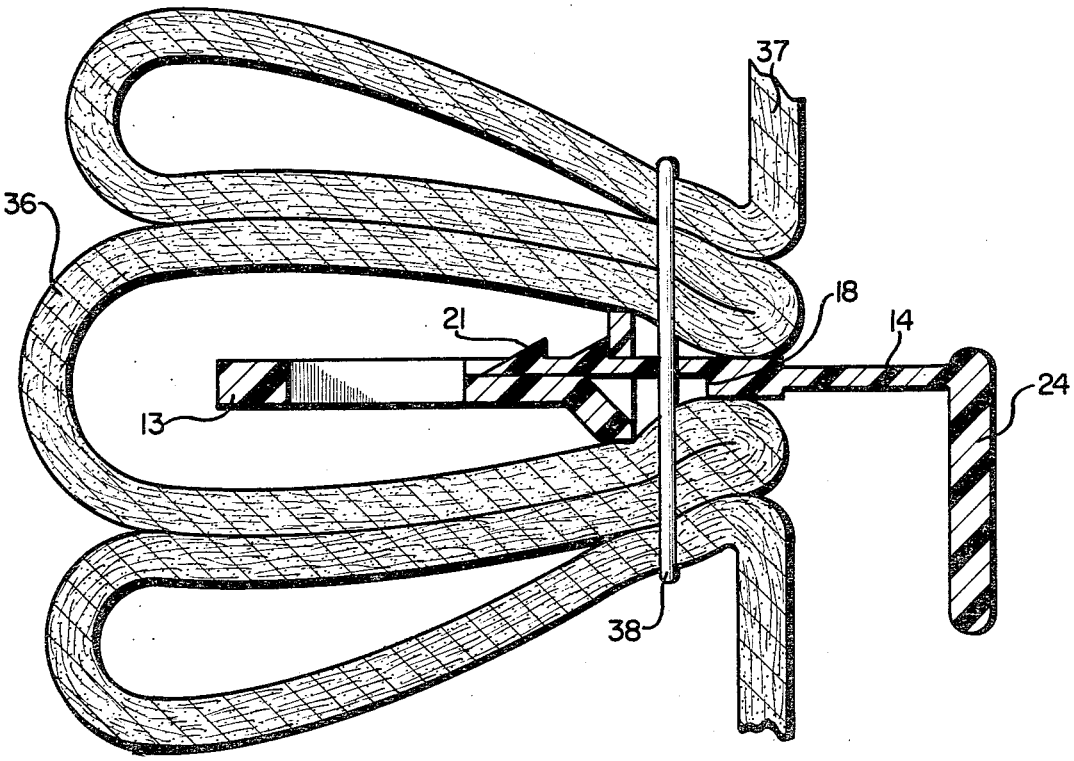
FIG. 6 is a cross-section along the line 6—6 of FIG. 3, showing the assembly in position between the folds of a pleat.
Figure 4:
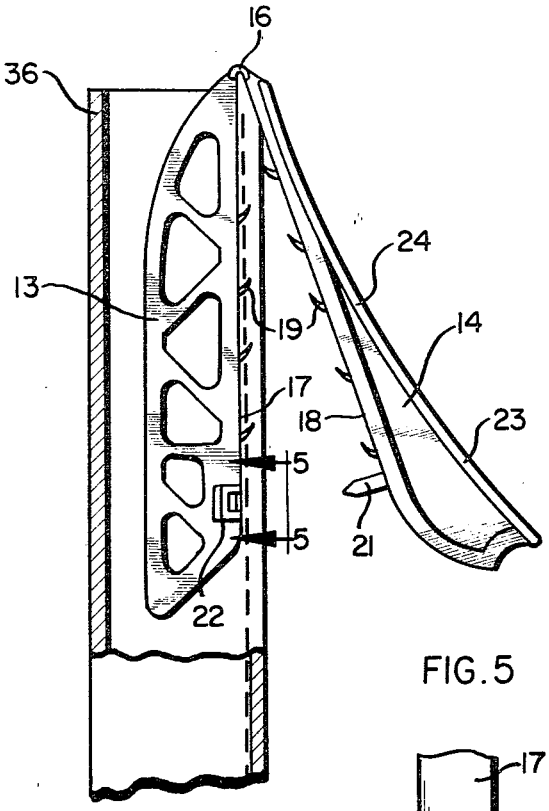
FIG. 4 is a view similar to FIG. 3 showing the assembly after insertion in a drapery pleat but before being locked in position.

For installation of the assembly in a finished pleated drapery, first plate 13 is inserted into the open end of a pleat, e.g., 36, at the top of drapery 37, with second plate 14 positioned to the rear of the drapery, until hinge 16 abuts the upper edge of the drapery. Prong 21 is then forced through either the drapery material or preferably the seam 38 which forms the pleat, as shown in FIG. 6, until prong 21 interlocks with latch 22. Hook assembly 12 is then attached to an appropriate point on locking rib 24, and the drapery is ready for hanging in the usual manner.

The foregoing detailed description has been given for clearness of understanding only, and no unnecessary limitations should be understood therefrom as modifications will be obvious to those skilled in the art.

What is claimed:

1. An adjustable support assembly for a drapery or the like comprising:

a first elongated plate member adapted to be inserted into a fold of a drapery;

a second elongated plate member having a first edge substantially aligned with an edge of said first plate member;

hinge means interconnecting an upper end of both said first and second plate members;

interlocking means on said first and second plate members, said interlocking means being spaced from said hinge means and adapted to interlock said plates, said means including prong means affixed to one of said plates adapted to penetrate said drapery fold positioned between said plates and latch means affixed to the other of said plates;

gripping means on at least one of said aligned edges of said plates for gripping said drapery fold;

a hook assembly including hook means for engaging a traverse rod or the like, said assembly being adapted to be removably attached to said second plate at a desired point along a second edge thereof opposite said first edge, said second edge tapering toward said first edge in a direction toward said hinge means; and attaching means for detachably securing said hook assembly to said second plate.

2. A drapery support assembly in accordance with claim 1 wherein said second edge is outwardly concave.

3. A drapery support assembly in accordance with claim 1 wherein said attaching means comprises an elongated rib secured to said second plate along said second edge, said rib being provided with a plurality of apertures spaced along the length thereof; and at least one barb outwardly projecting from said hook assembly, said barb being adapted to enter and interlock with any of said apertures.

4. A drapery support assembly in accordance with claim 3 wherein said barb comprises an outwardly projecting shaft and a transverse cross-member attached thereto, and said apertures have the form of an inverted T including a base portion sized to pass said cross-member and a stem portion adapted to receive said shaft.

5. A drapery support assembly in accordance with claim 2 wherein said prong means includes a barb and said latch means includes an aperture formed on the other of said plates adapted to receive said prong means, said aperture having a sloping surface terminating in a sharp edge which engages said barb of said prong means, whereby withdrawal of said barb from said aperture is inhibited.

6. A drapery support assembly in accordance with claim 1 which is integrally formed of a semi-rigid synthetic plastic material.

* * * * *